US008334742B2

(12) United States Patent
Irwin

(10) Patent No.: US 8,334,742 B2
(45) Date of Patent: Dec. 18, 2012

(54) QUIET ELECTROMAGNETIC ACTUATOR

(75) Inventor: James C. Irwin, Beavercreek, OH (US)

(73) Assignee: Saia-Burgess Inc., Vandalia, OH (US)

( * ) Notice: Subject to any disclaimer, the term of this patent is extended or adjusted under 35 U.S.C. 154(b) by 84 days.

(21) Appl. No.: 12/877,244

(22) Filed: Sep. 8, 2010

(65) Prior Publication Data

US 2011/0057753 A1 Mar. 10, 2011

Related U.S. Application Data

(60) Provisional application No. 61/240,547, filed on Sep. 8, 2009.

(51) Int. Cl.
*H01F 1/00* (2006.01)
*H01F 3/00* (2006.01)
*H01F 7/00* (2006.01)

(52) U.S. Cl. ..... 335/277; 335/257; 335/247; 335/248

(58) Field of Classification Search ..... 335/157, 335/220–282
See application file for complete search history.

(56) References Cited

U.S. PATENT DOCUMENTS

| | | | | |
|---|---|---|---|---|
| 1,226,748 | A * | 5/1917 | Burnham | 335/247 |
| 2,151,213 | A * | 3/1939 | Kelley | 335/261 |
| 2,931,617 | A * | 4/1960 | Jamieson | 251/54 |
| 3,134,932 | A * | 5/1964 | Ray | 335/257 |
| 4,272,748 | A * | 6/1981 | Fugate et al. | 335/271 |
| 4,405,912 | A * | 9/1983 | Palma et al. | 335/260 |
| 4,749,976 | A * | 6/1988 | Pichler | 335/257 |
| 5,044,563 | A | 9/1991 | Mesenich | |
| 6,095,201 | A * | 8/2000 | Zenoni et al. | 139/452 |
| 6,225,886 | B1 * | 5/2001 | Kleinert et al. | 335/257 |
| 2004/0201442 | A1 * | 10/2004 | Herbert et al. | 335/220 |
| 2008/0204176 | A1 | 8/2008 | Sriraksat et al. | |
| 2010/0097165 | A1 * | 4/2010 | Schilling | 335/257 |

FOREIGN PATENT DOCUMENTS

| | | | |
|---|---|---|---|
| DE | 38 34 444 | A1 | 4/1990 |
| FR | 2 923 936 | A1 | 5/2009 |
| JP | 62-166502 | A | 7/1987 |

OTHER PUBLICATIONS

Fig. 6 from U.S. Appl. No. 12/877,244.
International Search Report and Written Opinion mailed Mar. 9, 2011 in PCT Application No. PCT/US2010/002445.

* cited by examiner

*Primary Examiner* — Mohamad Musleh
(74) *Attorney, Agent, or Firm* — Nixon & Vanderhye, P.C.

(57) ABSTRACT

An electromagnetic actuator (20) comprises a stator (22), a piston (24), and a key (26). The stator comprises a stator frame (30) having an axial direction (32), the stator frame in turn comprising a magnetic member (50) and a base (52). The base (52) is separated by a gap (56) in the axial direction from the magnetic member (50) and positioned so that magnetic flux extending through the magnetic member (50) also extends through the base (52). The piston (24) is configured to reciprocate within the stator frame (30) in the axial direction (32). The key (26) is configured and position both to locate the base (52) with respect to the stator frame (and thereby provide the gap) and to absorb energy when the piston (24) strikes the base. A flux transfer flange (60) is configured to concentrate magnetic flux extending through the magnetic member (50) in a radial direction into the base (52).

29 Claims, 5 Drawing Sheets

QUIET ELECTROMAGNETIC ACTUATOR

This application claims the priority and benefit of U.S. Provisional Patent application 61/240,547, filed Sep. 8, 2009, entitled "QUIET MAGNETIC LATCHING ACTUATOR", which is incorporated herein by reference in its entirety.

BACKGROUND

I. Technical Field

This invention pertains to actuators such as solenoids and/including but not limited to magnetic latching actuators.

II. Related Art and Other Considerations

Some actuators have a piston or plunger which is electromagnetically attracted by energization of a coil in an axial direction of the plunger to a base member enclosed within an actuator housing. The base member is, in turn, in contact or aligned in the axial direction with yet another member. Such other member can be, for example, an actuator end cap of the housing or (in the case of a latching actuator, for example) magnetic material that facilitates holding of the piston toward the base even after the coil has been de-energized.

The piston striking the base upon coil energization can produce noise, as can the struck base contacting (or transmitting the sound through) the member with which the base is axially aligned. Normal magnetic latch actuators have magnetic bases that are rigidly mounted to maximize latching forces. One adverse effect of this design approach is very high audible noise levels which can occur when the magnetic base is struck by a reciprocating member, such as a plunger or piston of the actuator. In some instances a solid or elastomeric material intended to serve as a noise dampener may be placed axially between the base and the axially aligned member.

For example, FIG. 6 shows a magnetic latching solenoid comprising a plunger P that reciprocates through an opening in a solenoid end plate T. Upon energization of coil C the plunger is retracted into the solenoid frame F and strikes a base member B. An elastomer E is provided in an axial direction between base member B and frame F, and essentially serves as a cushion. A narrowed portion of base member B extends through frame F and has an enlarged riveted end R for retaining the base member B relative to frame F. Energization of coil C causes plunger P to travel toward and strike base member B, causing base member B to compress elastomer E and slightly drive riveted end axially. Because the riveted end R is magnetically attracted to frame F, the impact force of plunger P must exceed that magnetic attraction before elastomer E can start to compress. After de-energization of coil C, magnetic flux provided by magnet M, located at an opposite end of the solenoid from base member B, extends through the plunger P to hold plunger P in contact with base member B. The magnetic flux lines extend through the narrowed portion of base member B, resulting in higher flux density in the narrowed portion and thus causing more iron losses. The elastomer E is intended to provide some noise dampening when the plunger P strikes the base member B. However, the elastomer E is much stiffer in compression (in the axial direction) than in shear. Moreover, when the base member B returns to its original position, the enlarged riveted end R impacts frame F, thus causing an additional noise.

BRIEF SUMMARY

An electromagnetic actuator comprises a stator, a piston, and a key. The stator comprises a stator frame having an axial direction, the stator frame in turn comprising a magnetic member and a base. The base is separated by an air gap in the axial direction from the magnetic member and positioned so that magnetic flux extending through the magnetic member also extends through the base. The piston is configured to reciprocate within the stator frame in the axial direction. The key is configured both to position the base with respect to the stator frame (and thereby provide the air gap) and to absorb energy when the piston strikes the base. The base has no other contact in the axial direction other than contact with the piston.

The actuator further comprises a flux transfer flange configured to concentrate magnetic flux from the magnetic member in a radial direction into the base. In an example embodiment, the flux transfer flange comprises a ring radially positioned with respect to the base and in axial contact with the magnetic member. In the radial direction the magnetic member has greater surface area than either the base or the flux transfer flange. The flux transfer flange thus serves as a flux concentrator configured to funnel magnetic flux extending through the magnetic member into the base.

The key is configured to prevent the base from contacting the magnetic member when the piston strikes the base. The key is configured to absorb energy in both the axial direction and a radial direction when the piston strikes the base. The key is configured to position the base whereby the base can oscillate in the axial direction without contacting the magnetic member.

In an example embodiment the key is located in the axial direction between the flux transfer flange and the stator frame, with the base comprising a circumferential notch configured to at least partially accommodate the key. In an example embodiment the key comprises a resilient material, such as an elastomeric material (and can be, for example, an O-ring) or a material having a spring force (such as a leaf spring, for example).

The actuator further comprises a coil configured to cause the piston to reciprocate and to strike the base when the coil is energized.

In an example implementation in which the actuator is a magnetic latching actuator, the magnetic member is a permanent magnet configured to generate the magnetic flux which also extends through the base and thereby serves to latch the piston to the base.

In an example implementation in which the actuator is non-latching, the magnetic member is magnetized by energization of the coil.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. That is, those skilled in the art will be able to devise various arrangements which, although not explicitly described or shown herein, embody the principles of the invention and are included within its spirit and scope. In some instances, detailed descriptions of well-known devices, circuits, and methods are omitted so as not to obscure the description of the present invention with unnecessary detail. All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 1:
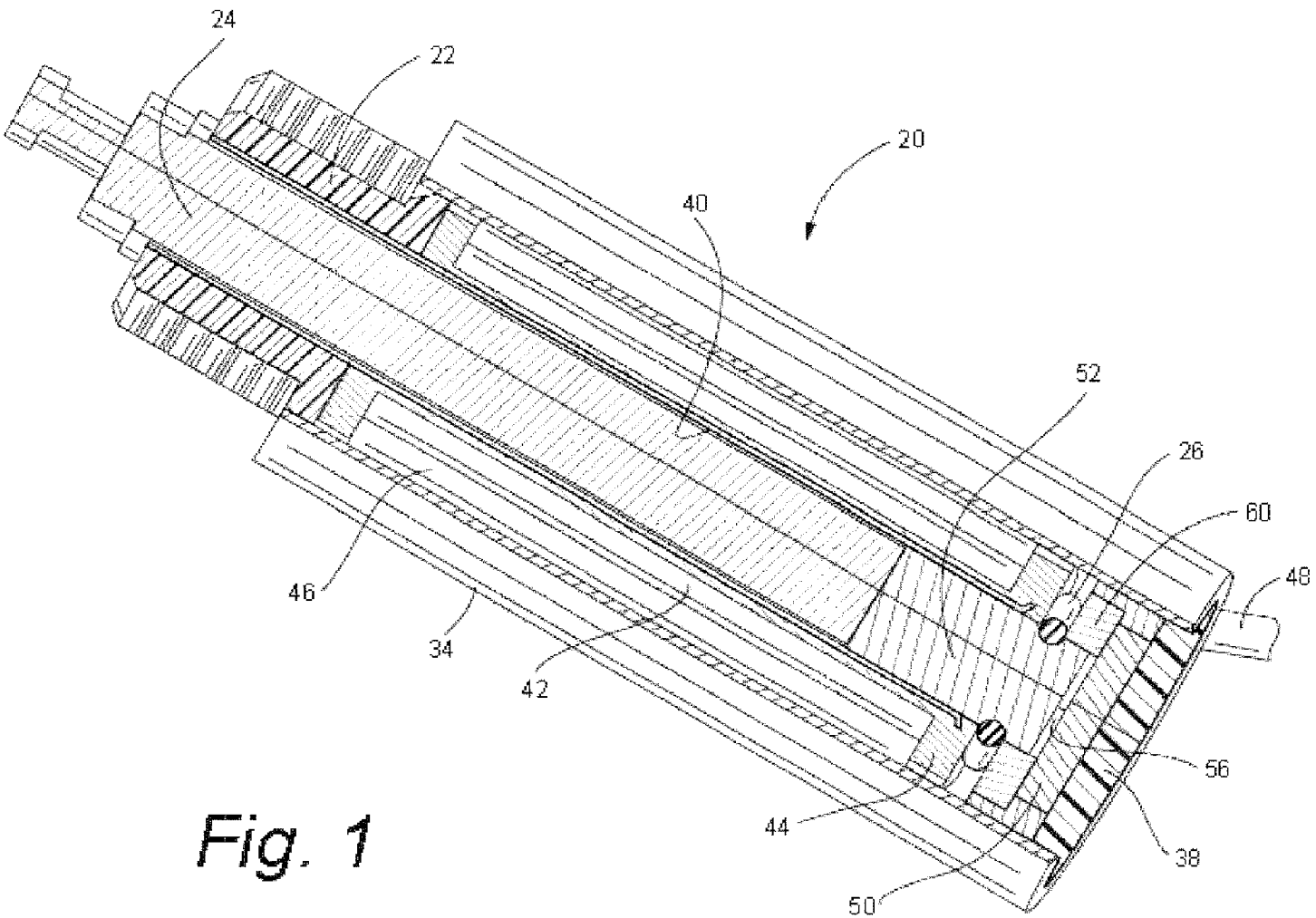
FIG. 1 is a sectioned side perspective view of an electromagnetic actuator of an example embodiment, showing a piston in an extracted or extended position.
Figure 2:
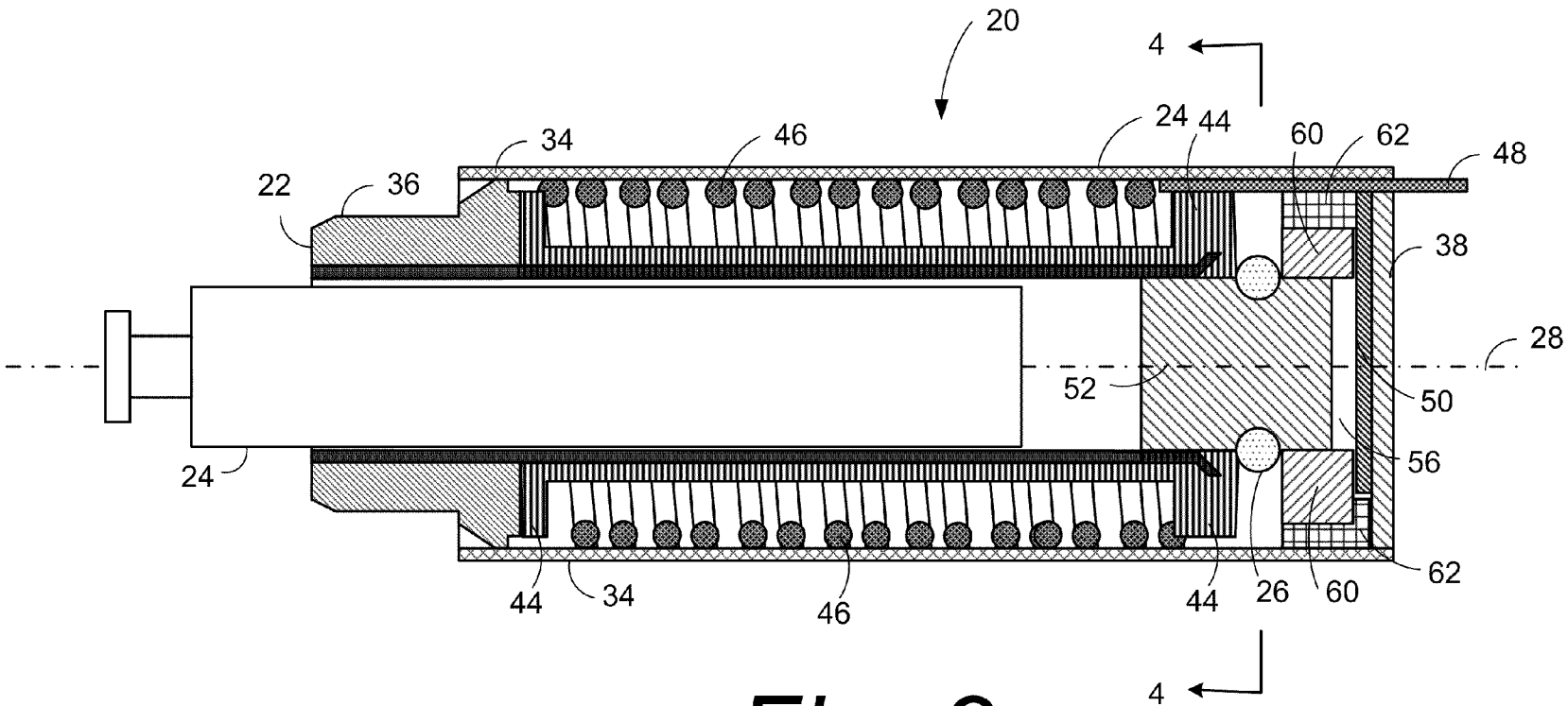
FIG. 2 is a sectioned side view of a stator portion of the electromagnetic actuator of FIG. 1.
Figure 3:
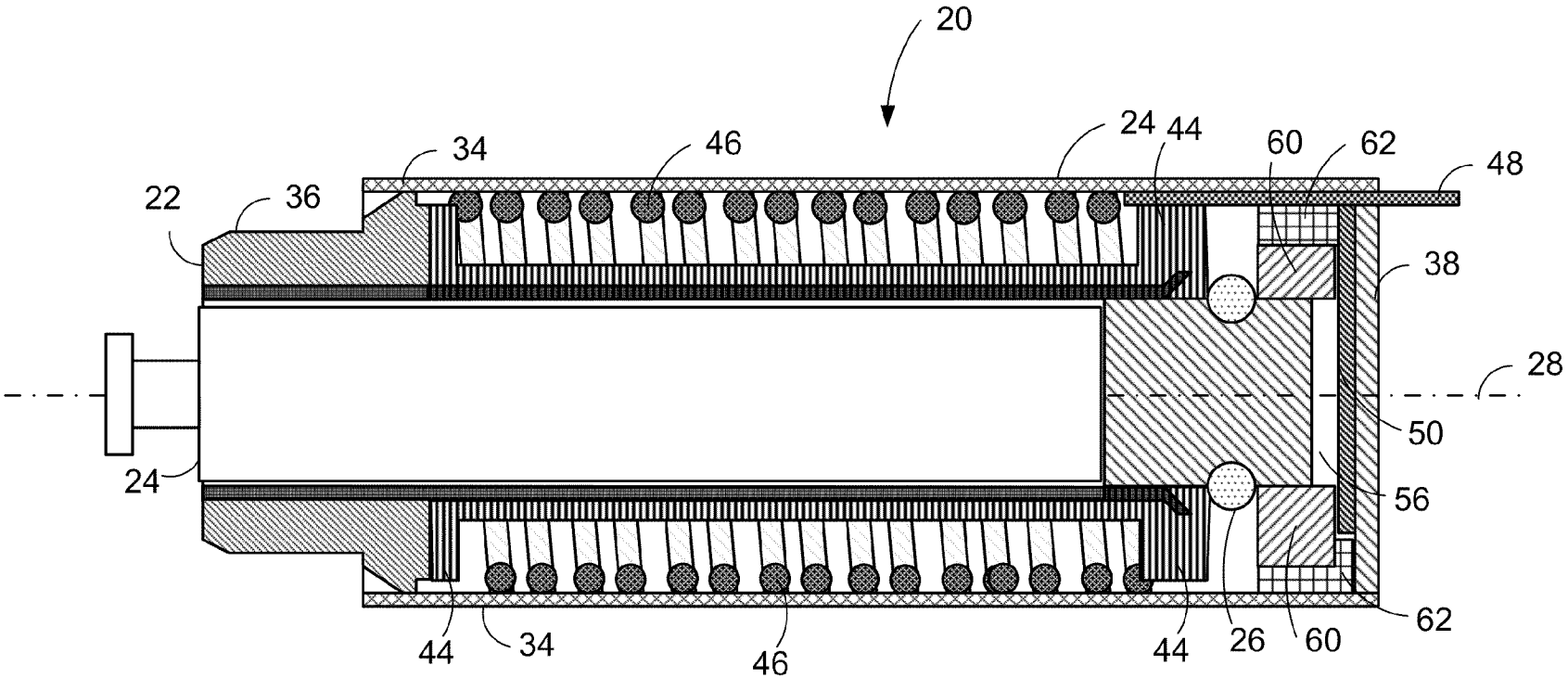
FIG. 3 is a sectioned side view of a stator portion of the electromagnetic actuator of FIG. 1, but showing a piston in a withdrawn or retracted position.

FIG. 1 and FIG. 2 illustrate an electromagnetic actuator 20 according to a non-limiting example embodiment of the technology disclosed herein. The actuator 20 comprises stator 22, piston 24 (also known as a plunger), and key 26. Piston 24 has an essentially solid cylindrical shape and is configured to reciprocate within stator 22 frame along longitudinal axis 28. FIG. 1 and FIG. 2 show piston 24 in its extended or activated position; FIG. 3 shows piston 24 in its retracted or withdrawn position. A working end of piston 24 may have various configurations for abutting or attaching to another member or surface upon which piston 24 acts.

The stator comprises stator frame 30 having an axis 28 (e.g., the axial direction). The stator frame 30 comprises a hollow essentially cylindrical stator case 34, stator nose cap 36, stator butt end plate 38, stator sleeve 40, bobbin 42. As shown in FIG. 2, stator nose cap 36 and stator butt end plate 38 are fitted into opposing axial ends of stator case 34. While the stator butt end plate 38 essentially serves to close the butt end of stator 22, the stator nose cap 36 has a central cylindrical opening adapted to receive piston 24. An interior surface of the cylindrical opening of stator nose cap 36 is aligned in axial direction 28 with a comparable cylindrical interior surface of bobbin 42. The interior surface of the cylindrical opening of stator nose cap 36 and the cylindrical interior surface of bobbin 42 are lined with stator sleeve 40. The stator sleeve 40 comprises a material which permits piston 24 to reciprocate easily within stator 22. The bobbin 42 comprises a hollow cylindrical bobbin core which extends along the axis 28 and radially extending bobbin flanges 44. An electrically conductive, magnetic field-producing coil 46 is wrapped around the bobbin core and retained in position by bobbin flanges 44. The coil 46 is connected by an electrical connector/conductor 48 to an unillustrated external source of electricity, and in so doing preferably extends through stator butt end plate 38.

The stator 22 further comprises magnetic member 50 and stator base 52. Stator base 52 is separated by air gap 56 in the axial direction (along axis 28) from the magnetic member 50 and positioned so that magnetic flux from magnetic member 50 also extends through base 52. In particular, key 26 is configured and position both to locate the base with respect to the stator frame (and thereby provide and maintain air gap 56) and to absorb energy when piston 24 strikes base 52 (when piston 24 returns from its extracted or extended position as shown in FIG. 1 and FIG. 2 to its retracted or withdrawn position of FIG. 3). Base 52 has no other contact in the axial direction other than contact with the piston 24. The stator base 52 thus essentially serves as an isolation mount component.

Thus, key 26 is configured to prevent stator base 52 from contacting magnetic member 50 when piston 24 strikes stator base 52. The key 26 is configured to absorb energy in both the axial direction (along axis 32) and a radial direction (perpendicular to axis 32 in the plane of FIG. 1 and FIG. 2) when piston 24 strikes stator base 52. For example, the key 26 is configured to position stator base 52 whereby stator base 52 can oscillate in the axial direction without contacting magnetic member 50. In an example embodiment the key is a resilient member and can comprise resilient material. As used herein, a "resilient member" encompasses, for example, an elastomeric member (comprising an elastomeric material) and/or any material which, when compressed, can provides a spring force. An example of a resilient material and can be (for example) an O-ring, as illustrated by way of example in the drawings. In another embodiment the key comprises a springy member such as a leaf spring, for example.

Figure 5:
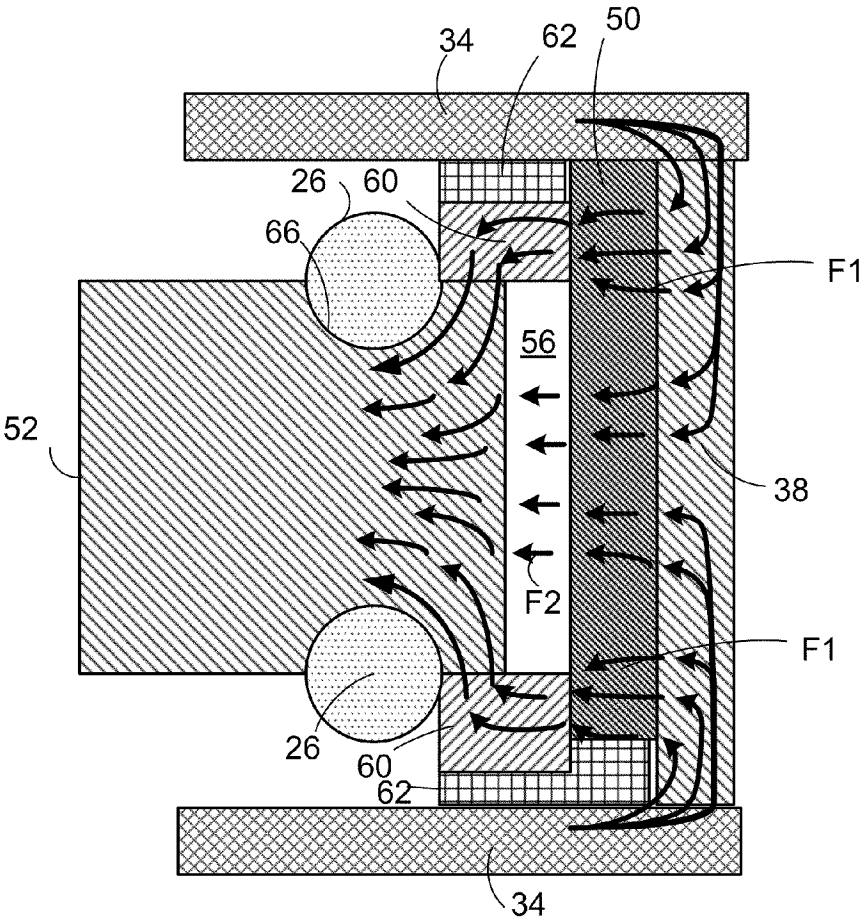
FIG. 5 is an enlarged view of an end portion of the stator of the electromagnetic actuator of FIG. 1.

The actuator 20 further comprises flux transfer flange 60. The flux transfer flange 60 is configured to concentrate magnetic flux from magnetic member 50 in a radial direction into stator base 52. FIG. 5 shows by arrows F1 the magnetic lines of flux which extend through base 52, magnetic member 50, and flux transfer flange 60. Some magnetic flux extends from magnetic member 50 into base 52 through the air gap 56, as depicted by arrows F2 shown in FIG. 5. Because there are flux lines going from the magnetic member 50 to the base 52, there will be a force that will preload the key 26 to an equilibrium point where the magnetic forces are balanced by the resilient force. In actuality, there will also be a radial force (since the base 52 and the flange 60 will never be perfectly concentric) such that the base 52 is not "perfectly" balanced.

In an example embodiment, the flux transfer flange 60 comprises a ring radially positioned with respect to stator base 52 and in axial contact with magnetic member 50. In the radial direction magnetic member 50 has greater surface area than either stator base 52 or flux transfer flange 60. The flux transfer flange 60 thus serves as a flux concentrator configured to funnel magnetic flux from magnetic member 50 into flux transfer flange 60.

In an example embodiment, key 26 is located in the axial direction between flux transfer flange 60 and stator frame 30, e.g., between flux transfer flange 60 and a bobbin flange 44. Both magnetic member 50 and flux transfer flange 60 are radially positioned and/or retained within stator base 52 by magnet guide 62. The magnet guide 62 can take the form of an annular ring having interior surfaces configured to mate with magnetic member 50 and flux transfer flange 60.

Figure 4:
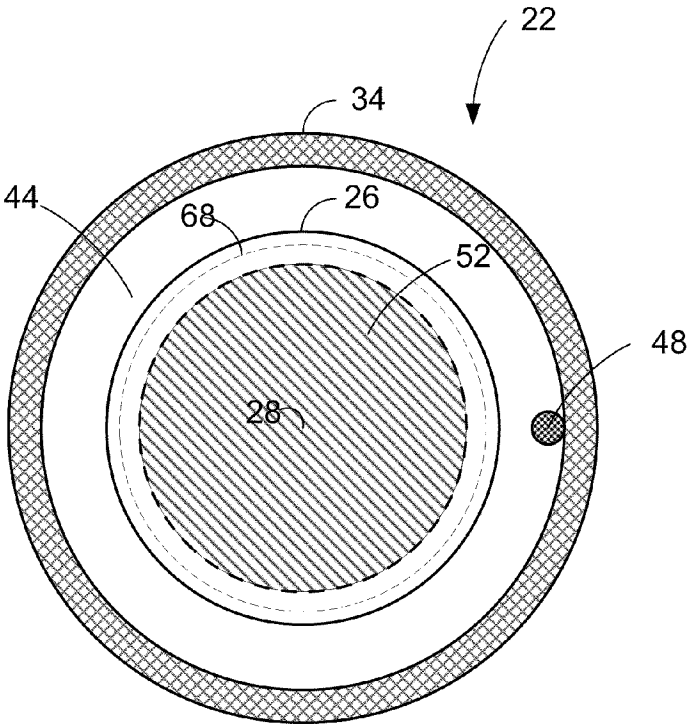
FIG. 4 is a sectioned end view of the stator portion of the electromagnetic actuator of FIG. 1 taken along line 4-4 of FIG. 2.
Figure 6:
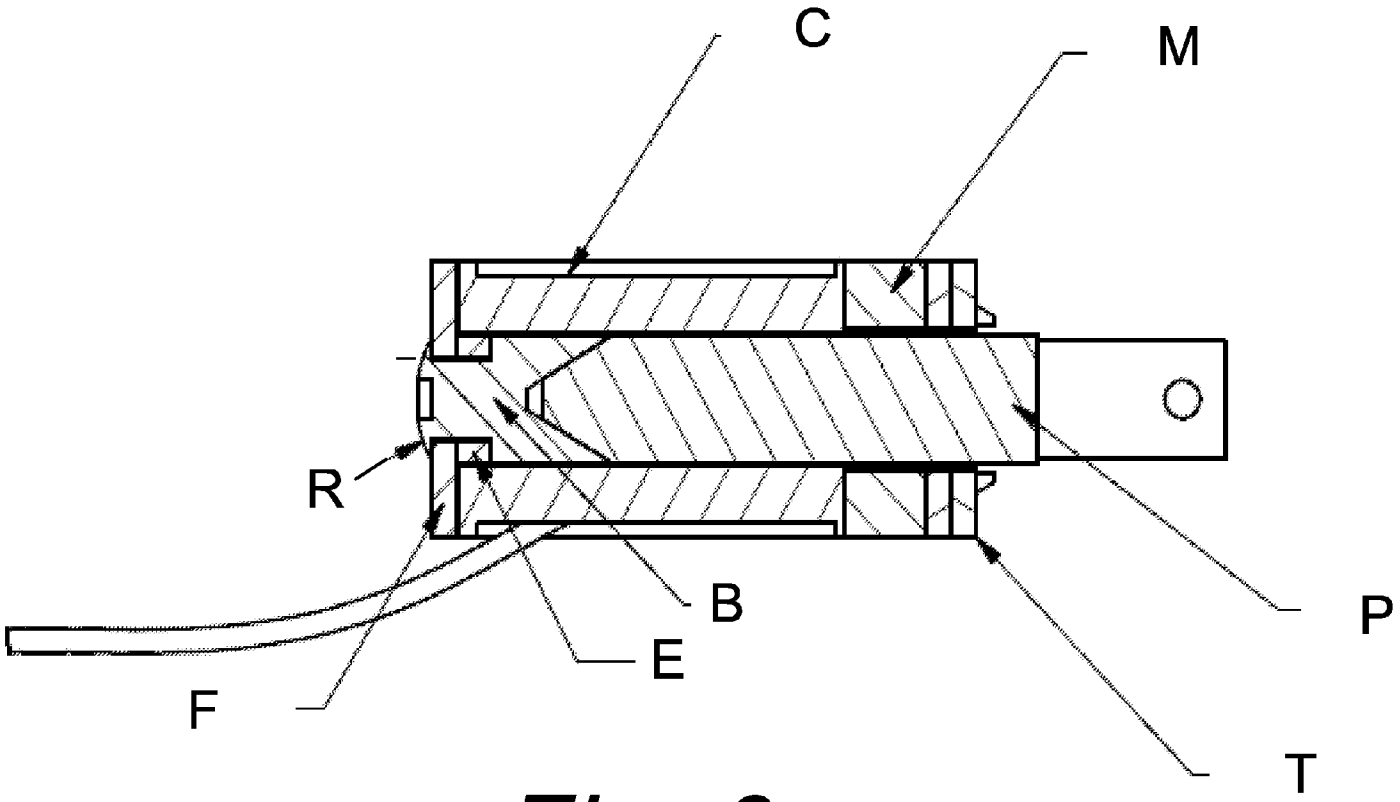
Fig. 6 PRIOR ART
FIG. 6 is a sectioned side view of a prior art actuator.

In an example embodiment the stator base 52 comprises a circumferential notch 66 configured to at least partially accommodate key 26. The notch 66 (shown enlarged in FIG. 5) is particularly but not exclusively employed when key 26 takes the form of an O-ring, as in the illustrated embodiments. In other embodiments key 26 can take other forms, such as the leaf spring mentioned above or any other resilient material. FIG. 4 shows a sectioned end view of the stator portion of the electromagnetic actuator of FIG. 2 taken along line 4-4 of FIG. 2 (as viewed from the butt end of actuator 20), and particularly shows by broken line 68 the exterior cylindrical surface of stator base 52.

In some example implementations the actuator is a magnetic latching actuator. In the magnetic latching implementations the magnetic member 50 is a permanent magnet configured to generate the magnetic flux which also extends through the base 52 and thereby serves to latch the piston to the base upon termination of energization of coil 46. In other example implementations, the actuator is non-latching, and the magnetic member 50 (rather than being a permanent magnet) is comprised of ferromagnetic material which magnetized by energization of coil 46 as the piston 24 is retracted or drawn into the actuator housing toward base 52. The figures thus generically serve to depict both latching and non-latching implementations.

FIG. 1 and FIG. 2 thus show an example embodiment of an electromagnetic actuator (e.g., solenoid) that significantly improves (e.g., lessens) audible impact noise levels while maintaining a required level of magnetic latching force. As shown in FIG. 1 and FIG. 2, a base such as stator base 52 is suspended from adjacent metallic components by use of a resilient or compressed elastomeric component, e.g., key 26. The resilient or elastomeric component can take the form of a ring (o-ring), for example. This resilient or elastomeric component is configured to absorb impact energy in both radial and axial directions, and works to reduce this energy to surrounding structural components. An additional radially located, but physically separated, ferromagnetic material (e.g., flux transfer flange or flux concentrator 60) counteracts the axial magnetic losses of this approach by providing a parallel magnetic path. Thus, lower audible impact noise is achieved through the isolation mount of the base components, but magnetic losses are minimized through the use of additional radial flux paths. This same arrangement or comparable arrangements can also be used to reduce audible noise level emissions on closing air gap solenoids without permanent magnets incorporated, e.g., in the non-latching implementations mentioned above.

The plunger (piston) of the actuator is located inside the actuator sleeve 40 and magnetically attracted to the base 52. Noise is caused by the plunger hitting the base. The base, when impacted by the plunger, will have some of the energy absorbed by the elastomeric support ring (o-ring). As a result of the absorption there will be less noise energy (e.g., fewer Decibels).

Although the resilient/elastomer component keys the base into a relatively fixed position, the base can move/oscillate axially (slightly), and thus absorb some of the noise energy. After the exponential decay of the oscillation, the resilient/elastomer component, acting through the base, positions the plunger to a fixed position (based on the rigidity of the elastomer).

The resilient/elastomer component thus serves to hold the base, non-rigidly oriented to the stator such that the base cannot directly pass shock waves (sound energy) induced from the impact, to the rest of the stator assembly. The air gap (e.g., air gap 56) between the base and the magnet is the space in which the base can move when impacted such that the impact energy is not passed from the base through the magnetic member to the stator. The resilient/elastomer component can thus be viewed to act like a shock absorber.

As indicated above, base has or works in conjunction with a base flange, e.g., flux transfer flange 60. The base flange or flux transfer flange 60 has two purposes. The first purpose is to transfer the magnetic flux from the base, around the magnetic gap (between the base and magnetic member), to the rest of the magnetic circuit. The second is to concentrate the flux extending through the magnetic member 50 into the base. The magnet area is much larger than the base area. Then the flange acts like a funnel and takes the large area of the magnetic member and reduces it to the smaller base area.

A consideration of the resilient/elastomeric component is that a minimal amount of the base is removed so the magnetic losses are minimized. The elastomeric conditions depend on the size and the impact: smaller lighter impacts can have a softer durometer, whereas a higher impact requires a higher durometer. The base/elastomeric interface is such that the major part of the base remains intact to allow flux to flow without losses.

Advantageously the base 52 has no other contact in the axial direction 28 other than contact with the piston 24. Only an air gap 56 is provided axially between base 52 and any other non-piston component, e.g., between base 52 and magnetic member 50. Thus in an example embodiment insertion of any solid (i.e., any non-air) dampening material between base 52 and magnetic member 50 can be avoided, since such solid material can create a larger or more significant gap and thus increase the required holding force in latching embodiments.

Another advantage for magnetic latching embodiments is that the magnetic member 50 (which is a permanent magnet in the magnetic latching embodiments) and resilient key 26 (which serves as a noise dampening feature) are both located essentially in one area, e.g., the butt area of the actuator housing. In an example embodiment, no portion of the coil 46 is situated between the magnetic member 50 and resilient key 26 in the axial direction 28. Such "same side location" of the magnetic member 50 and resilient key 26 relative to the coil 46 axially advantageously removes the permanent magnet from the coil winding space, which allows more coil windings (for a lower power for same performance or higher performance at the same power) which can also allow a smaller unit with the same performance/power requirements.

Although the description above contains many specificities, these should not be construed as limiting the scope of the invention but as merely providing illustrations of some of the presently preferred embodiments of this invention. It will be appreciated that the scope of the present invention fully encompasses other embodiments which may become obvious to those skilled in the art, and that the scope of the present invention is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein by reference and are intended to be encompassed hereby. Moreover, it is not necessary for a device or method to address each and every problem sought to be solved by the present invention, for it to be encompassed hereby.

What is claimed is:

1. An electromagnetic actuator comprising:

a stator comprising a stator frame having an axial direction, the stator frame comprising:

a magnetic member;

a base separated by an air gap in the axial direction from the magnetic member and positioned so that magnetic flux extending through the magnetic member also extends through the base;

a piston configured to reciprocate within the stator frame in the axial direction;

a key configured both to position the base with respect to the stator frame and thereby provide the air gap and to absorb energy when the piston strikes the base.

2. The apparatus of claim 1, wherein the base has no other contact in the axial direction other than contact with the piston.

3. The apparatus of claim 1, further comprising a coil configured to cause the piston to reciprocate and to strike the base when the coil is energized, and wherein no portion of the coil is situated between the magnetic member and the key in the axial direction.

4. The apparatus of claim 1, further comprising a coil configured to cause the piston to reciprocate and to strike the base when the coil is energized, and wherein the magnetic member is a permanent magnet configured to generate the magnetic flux which also extends through the base and thereby serves to latch the piston to the base.

5. The apparatus of claim 1, further comprising a coil configured to cause the piston to reciprocate and to strike the base when the coil is energized, and wherein the magnetic member is magnetized by energization of the coil.

6. The apparatus of claim 1, wherein the stator frame further comprises a flux transfer flange configured to concentrate magnetic flux extending through the magnetic member in a radial direction into the base.

7. The apparatus of claim 6, wherein flux transfer flange comprises a ring radially positioned with respect to the base and in axial contact with the magnetic member.

8. The apparatus of claim 6, wherein in the radial direction the magnetic member has greater surface area than either the base or the flux transfer flange.

9. The apparatus of claim 8, wherein the key is located in the axial direction between the flux transfer flange and the stator frame, and wherein the base comprises a circumferential notch configured to at least partially accommodate the key.

10. The apparatus of claim 1, wherein the key is configured to prevent the base from contacting the magnetic member when the piston strikes the base.

11. The apparatus of claim 1, wherein the key comprises resilient material.

12. The apparatus of claim 1, wherein the key comprises an O-ring.

13. The apparatus of claim 1, wherein the key is configured to absorb energy in both the axial direction and a radial direction when the piston strikes the base.

14. The apparatus of claim 1, wherein the key comprises an elastomeric material.

15. The apparatus of claim 1, wherein the key is configured to position the base whereby the base can oscillate in the axial direction without contacting the magnetic member.

16. An electromagnetic actuator comprising:

a stator comprising a stator frame having an axial direction, the stator frame comprising:

a magnetic member;

a base separated by an air gap in the axial direction from the magnetic member;

a piston configured to reciprocate within the stator frame in the axial direction;

a resilient member configured to suspend the base with respect to the stator frame and thereby maintain the air gap; and a flux concentrator configured to funnel magnetic flux extending through the magnetic member into the base.

17. The apparatus of claim 16, wherein the base has no other contact in the axial direction other than contact with the piston.

18. The apparatus of claim 16, further comprising a coil configured to cause the piston to reciprocate and to strike the base when the coil is energized, and wherein no portion of the coil is situated between the magnetic member and the resilient member in the axial direction.

19. The apparatus of claim 16, further comprising a coil configured to cause the piston to reciprocate and to strike the base when the coil is energized, and wherein magnetic member is a permanent magnet configured to generate the magnetic flux which also extends through the base and thereby serves to latch the piston to the base.

20. The apparatus of claim 16, further comprising a coil configured to cause the piston to reciprocate and to strike the base when the coil is energized, and wherein the magnetic member is magnetized by energization of the coil.

21. The apparatus of claim 16, wherein flux concentrator comprises a ring radially positioned with respect to the base and in axial contact with the magnetic member.

22. The apparatus of claim 16, wherein in the radial direction the magnetic member has greater surface area than either the base or the flux concentrator.

23. The apparatus of claim 22, wherein the resilient member is located in the axial direction between the flux concentrator and the stator frame, and wherein the base comprises a circumferential notch configured to at least partially accommodate the resilient member.

24. The apparatus of claim 16, wherein the resilient member is configured to prevent the base from contacting the magnetic member when the piston strikes the base.

25. The apparatus of claim 1, wherein the key comprises a leaf spring.

26. The apparatus of claim 16, wherein the resilient member comprises an Oring.

27. The apparatus of claim 16, wherein the resilient member is configured to absorb energy in both the axial direction and a radial direction when the piston strikes the base.

28. The apparatus of claim 16, wherein the resilient member is configured to position the base whereby the base can oscillate in the axial direction without contacting the magnetic member.

29. The apparatus of claim 1, wherein the key is configured both to position the base with respect to the stator frame and thereby provide the air gap and to absorb energy when the piston strikes the base while still maintaining magnetic attraction between the magnetic member and the base.

* * * * *